United States Patent [19]

Mueller

[11] 4,026,222

[45] May 31, 1977

[54] ADJUSTABLE LOAD-SUPPORTING STRUCTURE

[75] Inventor: William F. Mueller, Tarzana, Calif.

[73] Assignee: Christine E. Mueller, Tarzana, Calif.

[22] Filed: Apr. 12, 1976

[21] Appl. No.: 676,336

[52] U.S. Cl. ..... 108/146; 312/312

[51] Int. Cl.[2] ..... A47B 9/00

[58] Field of Search ..... 108/146, 144; 312/312

[56] References Cited

UNITED STATES PATENTS

| | | | |
|---|---|---|---|
| 550,443 | 11/1895 | Deal | 108/146 |
| 843,584 | 2/1907 | Clark | 108/146 |
| 2,649,137 | 8/1953 | Roberts | 108/146 |
| 3,285,208 | 11/1966 | Cohen | 108/146 |
| 3,885,846 | 5/1975 | Chuang | 108/146 X |

*Primary Examiner*—James T. McCall

[57] ABSTRACT

A load-supporting structure such as a table, seat, bench, shelf and the like, including at least one stationary member carrying a slidably adjustable surface which is adapted to support a load. The adjustable load-supporting surface has channel means associated therewith in which the stationary member is slidably disposed. A latching mechanism, pivotally carried by the load-supporting surface, is provided to frictionally engage the stationary member in the channel in order to hold the load-supporting surface in position on the stationary member. The latching mechanism has a positive clamping mechanical advantage so that the frictional pressure exerted by the latching mechanism on the stationary member is directly proportional to the amount of weight placed on the adjustable load-supporting surface. The latching mechanism is so constructed and arranged that upon the application of only a small amount of weight on the load-supporting surface, the frictional pressure of the latching mechanism on the stationary member is so great as to prevent disengagement of the latching mechanism and preclude movement of the adjustable load-supporting surface.

12 Claims, 3 Drawing Figures

Fig. 1
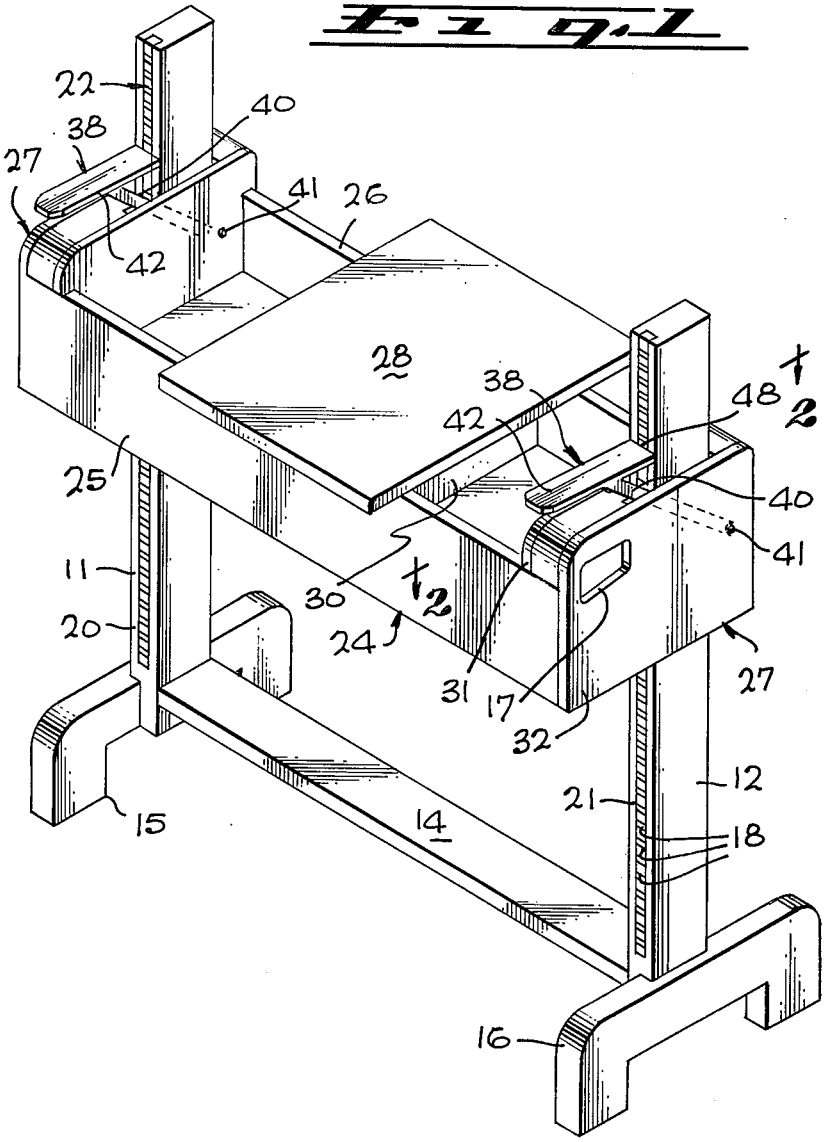
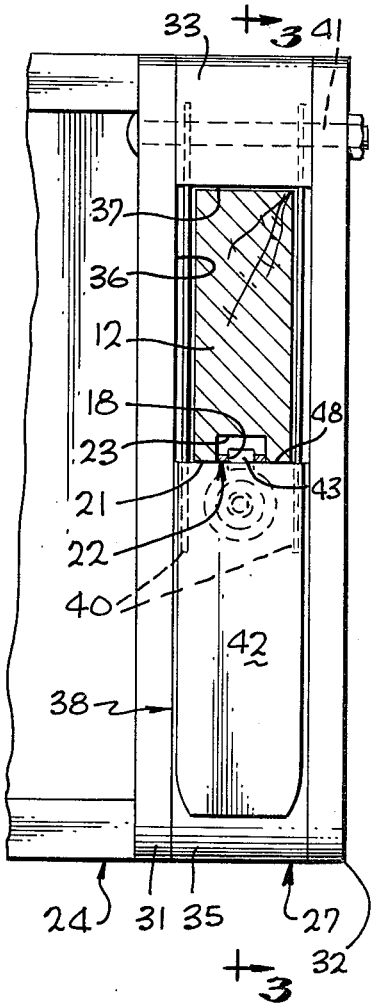
Fig. 2
Fig. 3
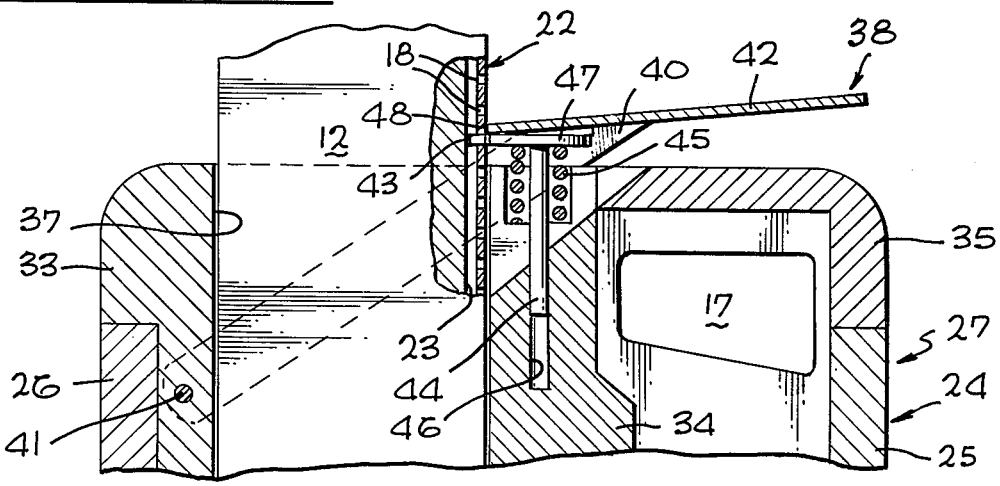

ADJUSTABLE LOAD-SUPPORTING STRUCTURE

BACKGROUND OF THE INVENTION

This invention relates to a load-supporting structure such as a table, seat, bench, shelf and the like, having an adjustable load-supporting surface. More particularly, it relates to a load-supporting structure having a latching mechanism which permits the load-supporting surface to be readily adjusted when no weight is on this surface, but which prevents disengagement of the latching mechanism and precludes movement of the load-supporting surface when weight or pressure is applied thereto.

Adjustable load-supporting structures are commonly used in home and industry. Examples of such structures include work benches and tables, seats and chairs, shelving, overbed tables, and the like. Thus, such structures may be used in association with a working surface of a fixed height to permit a person to adjust the height of a seating surface to an individual requirement. Alternatively, it may be desirable to adjust the height of a working surface relative to the height of the person working on such a surface.

To be satisfactory, an adjustable load-supporting structure must be capable of being readily adjusted to a number of predetermined positions. In addition to ease of adjustment, it is also necessary that such structures be provided with mechanisms which prevent movement of the load-supporting surface when a load is placed thereon, and which prevent accidental release of the adjusting mechanism while a load is on the load-supporting surface. Heretofore, this combination of requirements has been difficult to achieve in commercially available adjustable load-supporting structures. Thus, structures which are securely held in position when the load-supporting surface is occupied tend to be difficult to adjust. Structures which have mechanisms to permit the load-supporting surface to be readily adjusted frequently cannot be prevented from being released when weight is on this surface.

SUMMARY OF THE INVENTION

The present invention provides an adjustable load-supporting structure, such as a bench, table, seat, shelf, and the like, which may be readily adjusted to a desired position when the load-supporting surface is unoccupied, but which is securely fixed in position and precluded from movement at all times when weight or pressure is applied on the load-supporting surface. The structure of this invention comprises at least one stationary support member carrying a slidably adjustable surface adapted to support a load, the load-supporting surface being disposed substantially normal to the plane of the stationary support member. The load-supporting surface has a channel associated therewith in which the stationary member is slidably received. Extending between the adjustable load-supporting surface and the stationary member slidably disposed in the channel is a latching mechanism which fixes the position of the adjustable member against movement. The latching mechanism is so constructed that it may be disengaged, and the position of the load-supporting surface readily adjusted, when no weight is on the load-supporting surface. However, whenever weight or pressure is applied to the load-supporting surface, the latching mechanism cannot be disengaged and the load-supporting surface is precluded from movement.

The latching mechanism, which is carried by the load-supporting surface, includes a lever handle disposed adjacent one end of the channel and biased into engagement with the stationary support member in the channel at a point adjacent the load-supporting surface, and at least one lever arm secured to the lever handle. The lever arm extends from the lever handle, through the channel exterior of the stationary member in the channel, and is pivotally secured to the load-supporting surface adjacent the end of the channel opposite that end at which the lever handle is disposed. Preferably the lever handle is disposed at a slight angle, that is, less than about 10° relative to the plane of the load-supporting surface, and the lever arm is secured to the handle at an angle of between about 25° to 50° relative to the plane of the handle. When no weight is on the load-supporting surface, the lever handle may be pivoted away from engagement with the stationary member to permit the load-supporting surface to slide freely over the stationary member so that the position of the load-supporting surface may be adjusted relative to the stationary member. However, when weight or pressure is applied on the load-supporting surface, it is carried through the lever arm and lever handle causing the handle to be forced into tight frictional engagement with the stationary member in the channel at a point adjacent the load-supporting surface. The latching mechanism of the invention has a positive clamping mechanical advantage so that the amount of pressure exerted by the lever handle on the stationary member is directly proportional to the amount of opposing weight placed on the load-supporting surface. Upon the application of only a small amount of weight or pressure on the load-supporting surface, the lever handle exerts such a great amount of pressure on the stationary member as to preclude disengagement of the lever handle or movement of the load-supporting surface.

The channel in which the stationary support member is positioned may be formed in the load-supporting surface, or alternatively, may be formed as a separate unit which is secured to the load-supporting surface. The cross-sectional area of the channel must be slightly greater than that of the stationary support member to permit the stationary member to slide freely through the channel. However, the ends of the channel should be sufficiently near the ends of the stationary member to prevent movement of the stationary member when the lever handle is forced into engagement therewith. Thus, when weight is applied to the load-supporting surface and the lever handle forced against the stationary member, the upper edge of the channel opposite the lever handle is brought into tight frictional engagement with the stationary member. The stationary support member, in effect, is tightly clamped between the lever handle and the upper edge of the channel.

Preferably the stationary support member comprises one or more vertically extending rigid posts or legs which carry a vertically adjustable, horizontally extending load-support surface. If a single supporting post is utilized, a horizontal, cantilevered load-support surface may be slidably mounted on the post. If two or more vertical posts are utilized, the horizontal load-support surface will extend between the posts, with the posts being slidably received in channels provided in or on the horizontal member. Generally, a latching mechanism is provided for each post. Suitable base supports for the stationary posts are, of course, provided.

According to a preferred embodiment of the invention, a plurality of spaced notches are provided along the longitudinal surface of the stationary member or post which is disposed in the channel adjacent the lever handle. A pawl, in the form of a rigid bar adapted to be inserted in the slots, is secured to the lever handle so that the pawl extends a short distance beyond the front surface of the handle. Thus, when the lever handle is biased into engagement with the stationary member, the pawl is inserted into one of the slots carried by the support member to hold the horizontal load-support surface at a predetermined position until weight or pressure is applied thereto.

DESCRIPTION OF THE DRAWINGS

In the drawings:

FIG. 1 is a perspective view of a preferred embodiment of the adjustable load-supporting structure of the present invention.

FIG. 2 is a top plan view, partly in section, taken along lines 2—2 of FIG. 1.

FIG. 3 is a cross-sectional view, partly broken away, taken along lines 3—3 of FIG. 2.

DESCRIPTION OF A PREFERRED EMBODIMENT

A vertically adjustable bench is illustrated in the drawings as exemplary of the adjustable load-supporting structure of this invention.

The preferred embodiment shown includes a pair of vertically disposed stationary posts 11 and 12 which are secured in parallel spaced apart relation and braced at their lower ends by cross-bar 14. A pair of U-shaped base members 15 and 16 are secured to the lower ends of the posts by any suitable means, such as, for example, screws. A plurality of slot apertures or notches 18 are provided along parallel longitudinal surfaces 20 and 21 of the posts, the notches or slots extending from a point adjacent the lower ends of the posts to a point at or near the upper end of the posts. While the notches or slots may be formed directly in the longitudinal surface of the posts, preferably they are formed in a separate bar or strip 22 which is secured in a groove 23 provided in the longitudinal surface of the posts. The slots or notches on one leg are vertically aligned with those on the other leg.

A vertically adjustable, load-supporting seat frame 24 is slidably disposed between the posts, with the posts extending through channels 36 at both ends of the seat frame. The load-supporting seat frame illustrated in FIG. 1 comprises opposed front and back members 25 and 26 and opposed end members 27 in which the channels 36 are provided. A seat 28 extends across the top of the front and back members intermediate the end members and may be fixedly or hingedly secured thereto. Preferably a panel (not shown) is provided across the bottom of the seat frame and one or more transverse partitions 30 extend between the front and back members 25 and 26 so that the seat frame may be used for storage of materials.

Both end members 27 comprise a pair of parallel panels 31 and 32 secured to the front and back members 25 and 26 of the seat frame and are maintained in spaced apart relation to form a channel therethrough by front, middle and back spacing pieces, 33, 34 and 35 respectively, secured between panels 31 and 32. Thus, the front and middle spacing pieces 33 and 34 are spaced apart a distance sufficient to provide a channel 36 through the end pieces of the seat frame which is adapted to slidably receive the posts 11 and 12. As seen in FIG. 2, the channel 36 has a cross-sectional area slightly greater than that of the posts to permit the seat frame 24 to slide freely over the stationary posts. The end surfaces 37 of the channels, formed by the inner edges of spacing pieces 33 and 34, are in close proximity to the longitudinal surfaces of the posts. Handle cut outs 17 are provided at both ends of the seat frame to facilitate raising and lowering the seat frame.

A latching mechanism 38, which serves to lock and unlock vertical movement of the seat frame, is carried by the seat frame adjaent each post. The latching mechanism, which extends between opposing ends of the channel, includes a rigid lever handle 42 having a pair of downwardly extending lever arms 40 secured to the handle by any suitable means such as welding. The end 48 of the lever handle is engagable with the slot-containing longitudinal surface of the post in the channel at a point adjacent the seat frame. As subsequently explained the frictional pressure of the lever handle against the longitudinal surface of the post holds the load-supporting seat frame securely in position. Lever arms 40 extend downwardly from the handle 42 adjacent one end of the channel, through the channel 36, exterior of the post in the channel, and are pivotally secured to the seat frame adjacent the opposing end of the channel, such as by bolt 41. This enables the lever handle to be pivoted away from the longitudinal surface of the post when the lever handle is depressed. Preferably the lever handle 42 is positioned at a slight angle, usually less than 10°, to the plane of the seat frame, and the lever arms extend downwardly from the handle at an angle of between about 25° to 50° relative to the plane of the handle. In order to facilitate pivotal movement of the latching mechanism, the edges of spacing piece 33 are notched adjacent bolt 41 to accommodate the lever arms 40. Similarly, angled notches are provided at both edges of spacing pieces 34 and 35 to accommodate the lever arms.

A pawl or dog element 43 in the form of a rigid, flat bar is secured to the lever handle and extends beyond the end 48 of the handle a distance sufficient to permit the pawl to be inserted into a slot aperture 18 when the end of the handle is biased against the longitudinal surface of the post. The pawl has a width only slightly less than that of the slots 18 to ensure substantial frictional engagement when the pawl is inserted in a slot.

The lever handle 42 is normally biased against the longitudinal surface of the adjacent post by compression spring 45 and pin 44 disposed between the seat frame and the handle. As shown in FIG. 3, the pin, which has an enlarged head, may be slidably disposed in hole 46 provided in a spacing piece, the hole having an enlarged upper portion 47 in which the compression spring is seated.

The adjustable load-supporting seat frame is held securely in position by the pressure of the end 48 of the lever handle 42 against the longitudinal surface of the post. When unoccupied, the seat frame may be readily raised or lowered by merely depressing the lever handles at both ends of the seat frame. This causes the lever handle to be pivoted away from the post, thereby disengaging the end of the handle from the longitudinal surface of the post and the pawl from the slot aperture. With the handles thus depressed, the seat frame slides freely over the posts so that the height of the seat frame may be adjusted. When a desired height is obtained, the seat is locked in position merely by releasing the handles. Since the handles are normally spring biased in an upward direction, when the handles are released the end of the handles are forced into contact with the longitudinal surface of the post and the pawl is inserted into a slot aperture at the desired height. At this point, with no weight or pressure being applied to the seat frame, the seat frame is held in position on the posts primarily by the frictional engagement of the pawl in the slot, with the handle exerting little pressure against the post. However, whenever downward weight or pressure is applied to the seat frame, the end of the lever handle is forced into tight frictional engagement with the longitudinal surface of the post to support the seat frame securely in position on the post.

The latching mechanism, which is carried by the seat frame, is constructed and arranged to have a positive clamping mechanical advantage so that the pressure exerted by the lever handle on the post is directly proportional to the amount of opposing weight of pressure applied on the seat frame. Thus, the latching mechanism has a high mechanical advantage. When even a small amount of weight or pressure, for example 10 pounds or more, is applied to the seat frame, the lever handle exerts such a great amount of pressure against the post as to prevent disengagement of the handle from the post and preclude movement of the seat frame. Under such conditions the lever handle cannot be depressed or pivoted away from the post, until the weight is removed from the seat frame. Lateral movement of the post when pressure is applied thereto by the lever handle is prevented by seat frame at the opposing end of the channel, that is, the end of the channel opposite that end at which the handle is disposed. When weight or pressure is applied to the seat frame, the post is, in effect, clamped securely between the lever handle and the top portion of the seat frame at the opposite end of the channel.

While the invention has been described with reference to a particular preferred embodiment, it is to be understood that this is only illustrative and not intended to limit the scope of the invention. For example, while the invention has been described with reference to a bench having a pair of stationary posts, it is to be understood that one, two or more posts may be utilized depending on the type of structure, size, and the like. Accordingly, it is intended that variations and modifications which fall within the scope of the appended claims be included.

What is claimed is:

1. An adjustable load-supporting structure which comprises a stationary support member, an adjustable member slidably mounted on said stationary member, said adjustable member having a surface substantially normal to the stationary member which is adapted to support a load and having channel means associated therewith in which said stationary member is slidably received, and lever means extending between opposing ends of said channel means pivotally carried by the adjustable member and adapted to frictionally engage the stationary member in said channel means adjacent one end of the channel means and to exert a positive clamping mechanical advantage on said stationary member when a load is applied to said adjustable member.

2. The structure defined in claim 1 in which the lever means comprises handle means adjacent one end of said channel means, the handle means having a surface frictionally engagable with a surface of the stationary member disposed in said channel means, and at least one lever arm secured to said handle means, the lever arm being pivotally secured to the adjustable member adjacent the end of the channel means opposite that end which is adjacent said handle means.

3. The structure defined in claim 2 in which said lever means comprises a pair of lever arms secured to said handle means in parallel, spaced-apart relationship, said arms extending from said handle means through said channel means exterior of the stationary member in the channel and being pivotally secured to said slidably adjustable member.

4. The structure defined in claim 3 in which said lever arms are secured to said handle means at an angle of between about 25° and 50° relative to the plane of the handle means and said handle means is disposed at an angle of less than 10° relative to the plane of the adjustable member.

5. The structure defined in claim 2 in which pawl means are secured to said handle means and extend beyond the surface of the handle means engagable with said stationary member.

6. The structure defined in claim 1 in which said stationary member comprises at least one vertically extending post member having a plurality of slot apertures along one longitudinal surface thereof, said adjustable member comprises a horizontally extending member slidably mounted on said post member and adapted to carry a load, said horizontally extending member having channel means associated therewith in which said post member is slidably received, and the lever means is adapted to frictionally engage the longitudinal surface of the post member having said slot apertures at a point exterior of said channel means and is pivotally carried by said horizontally extending member.

7. The structure defined in claim 6 in which said lever means comprises a lever handle adjacent the post member disposed in said channel means and being biased into engagement with the longitudinal surface of the post member carrying said slot apertures, pawl means secured to said lever handle and being adapted to be inserted in one of the slot apertures and a pair of lever arms secured to said handle and extending downwardly through said channel means exterior of the post in the channel means, the lever arms being pivotally secured to said horizontally extending member adjacent the end of the channel means opposite that end which is adjacent the lever handle.

8. A vertically adjustable bench which comprises a pair of vertically disposed posts supported in parallel spaced apart relation, both of said posts having a plurality of vertically aligned slot apertures along one longitudinal surface thereof, a horizontally disposed seat frame slidably mounted on said posts, said seat frame having opposed end members and a load-supporting seat member extending between said end members, both of said end members having channel means adapted to slidably receive said posts, and latching means pivotally carried by the seat frame adjacent each channel means, said latching means being pivotally secured to said seat frame adjacent one end of said channel means and having a surface engagable with the longitudinal surface of the post at the opposing end of said channel means at a point exterior of said channel means.

9. The apparatus defined in claim 8 in which said latching means comprises handle means having a surface engagable with said longitudinal surface of the post disposed in the channel means and a pair of downwardly extending arms secured to said handle means, said arms extending through the channel means and being pivotally secured to said seat frame.

10. The apparatus defined in claim 9 in which said handle has a pawl secured thereto, said pawl being adapted to be inserted in one of said slot apertures.

11. The apparatus defined in claim 8 in which said latching means is normally biased into engagement with said longitudinal surface of the post in said channel means.

12. The apparatus defined in claim 8 in which said opposed end members each comprise a pair of vertically disposed panels secured to said opposed side members in substantially parallel spaced apart relation and having plurality of spacing means secured between said vertically disposed panels, said spacing means being positioned to provide said channel means through said end members in which the posts are slidably received.

* * * * *